United States Patent [19]

Ault et al.

[11] Patent Number: 4,856,243

[45] Date of Patent: Aug. 15, 1989

[54] ASSEMBLIES FOR WINDOWS AND DOORS

[75] Inventors: Russell L. Ault, Newark; Wesley E. Legg, Bexley; Richard A. Mott, Alexandria, all of Ohio

[73] Assignee: Owens-Corning Fiberglas Corporation, Toledo, Ohio

[21] Appl. No.: 224,030

[22] Filed: Jul. 25, 1988

[51] Int. Cl.[4] ..... E06B 3/66; E06B 7/12

[52] U.S. Cl. ..... 52/304; 52/309.9; 52/790

[58] Field of Search ..... 52/303, 304, 305, 790, 52/171, 309.9

[56] References Cited

U.S. PATENT DOCUMENTS

| | | | |
|---|---|---|---|
| 1,877,685 | 9/1932 | Ottenheimer . | |
| 2,202,694 | 5/1940 | Haux | 52/304 |
| 2,276,112 | 3/1942 | Stoneback . | |
| 2,316,993 | 4/1943 | Sherwood | 52/790 X |
| 3,001,248 | 9/1961 | Verhagen | 52/304 |
| 3,771,276 | 11/1973 | Stewart et al. . | |
| 3,810,331 | 5/1974 | McCurdy et al. . | |
| 3,866,373 | 2/1975 | Hudock | 52/309.1 |
| 4,333,283 | 6/1982 | Ebata | 52/202 |
| 4,450,660 | 5/1984 | Dean et al. . | |
| 4,545,160 | 10/1985 | Grether et al. . | |
| 4,553,364 | 11/1985 | Legg et al. . | |
| 4,627,206 | 12/1986 | Cox . | |
| 4,640,065 | 2/1987 | Harris et al. . | |
| 4,681,772 | 7/1987 | Carter et al. . | |

FOREIGN PATENT DOCUMENTS

| | | | |
|---|---|---|---|
| 504946 | 8/1954 | Canada . | |
| 2650740 | 5/1977 | Fed. Rep. of Germany | 52/790 |
| 54098 | 2/1967 | German Democratic Rep. | 52/304 |
| 121849 | 6/1948 | Sweden | 52/304 |

OTHER PUBLICATIONS

Advertisement for Guardian Acousta-Glazed Windows, Glass Magazine, Apr. 1987.

Advertising Brochure for Acoustical Windows by DeVac.

*Primary Examiner*—John E. Murtagh

*Attorney, Agent, or Firm*—Patrick P. Pacella; Ted C. Gillespie

[57] ABSTRACT

An assembly for multipaned windows and/or doors is fabricated from sashes having a fibrous wool core and a polymeric outer shell. The sash contains a plurality of orifices through the shell, but not the core, to provide a filtered path for air and moisture movement in and out of the cavities between panes to reduce the condensation of moisture on the panes.

16 Claims, 1 Drawing Sheet

ASSEMBLIES FOR WINDOWS AND DOORS

TECHNICAL FIELD

This invention relates to sashes for windows and doors, fixed or moveable.

BACKGROUND

Up to one-third of a building's heat is lost thrugh windows. Double and triple glass panes are now frequently specified to combat this heat loss. Many manufacturers are attempting to increase the "R" value (resistance to heat conduction) int heir window sashes and mullions. Some metal window sashes are now fabricated with thermal breaks, or gaps between opposed metal sash components, to reduce heat conduction as well as condensation on the room side of the sash. Wood window sashes are also being specially designed to reduce heat loss and condensation. Wood is not as dimensionally stable as metal and it can dry out and warp. This can produce cracks allowing air infiltration and heat loss.

Improved windows, fabricated from lineals having a fibrous glass wool core and a hardened resinous or polymeric outer surface are disclosed in U.S. Pat. Nos. 4,553,364 issued to Legg et al. and 4,640,065 issued to Harris et al. Further, U.S. Pat. No. 4,681,772 issued to Carter et al. discloses a system for molding or fabricating such lineals.

One problem common to all multipaned window systems, i.e., wood, metal or composite, is controlling moisture between the panes. Excess moisture in the cavity between the panes results in a foggy window. Some try hermetically sealing the cavity between the panes. Such seals are prone to failure, which requires replacement of the unit. Others adopted various systems for venting the cavity to the atmosphere. such vents can permit dirt and insects to enter the cavity, which requires cleaning of the interior of the unit. There is a need for improved window assemblies and door assemblies to vent window cavities to the outside atmosphere while prohibiting dirt and insects from entering the window cavity.

STATEMENT OF THE INVENTION

The present invention modifies the molded wool/-polymeric sash to vent the cavity to the atmosphere in a novel manner to prevent dirt and insects from entering in cavity. The venting is accomplished by providing holes or orifices in the shell or resinous outer portion of the sash to enable air and moisture to flow through the sash, where the path for such flow is through the fibrous material making up the core of the sash. The fibrous material acts as a filter to eliminate insects and dirt from the cavity.

According to this invention there is provided an assembly for a window or door comprising a sash having a fibrous wool core and a hardened resinous outer surface, the sash being configured to receive at least two spaced apart panes, the panes defining a cavity region therebetween, the resinous surface of the sash having a plurality of orifices exposing the wool core to (a) the cavity between the panes and (b) the exterior of the sash to permit movement of air and moisture between the cavity between the panes and the exterior of the sash, where the movement of the air and moisture is through the wool core, with the wool core acting as a filter. Enabling the moisture to escape prevents fogging and extends the life of the window or door. Unlike hermetically sealed insulating glass units, this invention allows the space between the pane to breathe, preventing a pressure differential from building up and damaging the unit. This allows window units or door units manufactured at sea-level to be shipped into regions at higher altitudes without damaging the glass unit, thereby extending the unit's life.

In a preferred embodiment of the invention, a spacer means is positioned between the panes, where the spacer means has apertures in communication with the orifices in the sash to permit air movement through the sash. Most preferably, the apertures and the spacer means are aligned with the orifices in the sash.

In a preferred embodiment of the invention, the spacer is fabricated from a lineal having a fibrous glass wool core and a hardened resinous outer surface. The apertures in the spacer can extend either completely through the spacer or only through the resinous outer surface.

In one particular embodiment of the invention, the orifices in the sash exposed to the cavity are coaxially aligned on opposite sides of the sash lineal with the orifices exposed to the exterior of the sash.

In yet another embodiment of the invention, the assembly comprises three spaced apart panes defining two cavities therebetween, where each cavity is vented to the exterior of the sash, through the wool core of the sash, with the wool core acting as a filter.

DESCRIPTION OF THE INVENTION

Figure 1:
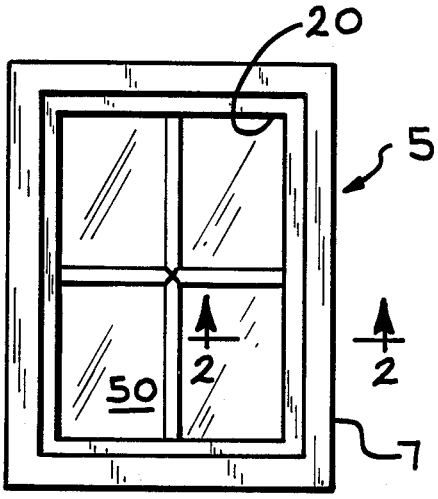
FIG. 1 is a frontal view in elevation of a window according to the principles of the present invention.

Window 5 in FIG. 1 is comprised of frame 7 and sash 20. It is to be understood that as employed herein the "sash" refers to the pane holding members for all types of windows or doors, e.g., movable or fixed, casement or double hung, etc. The frame can be comprised of any suitable material, such as wood, aluminum, or composite material. As shown, the sash holds pane 50.

Figure 2:
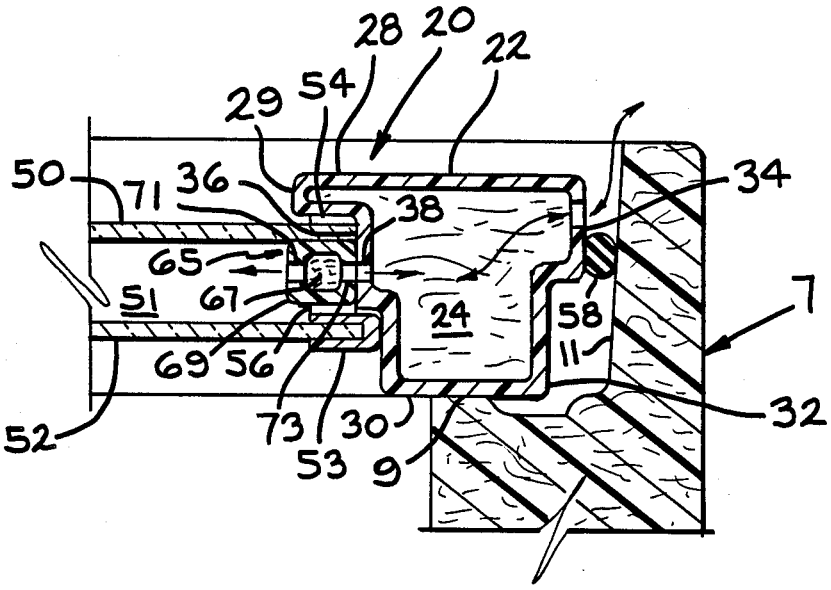
FIG. 2 is an enlarged cross-sectional view, taken along lines 2—2, of the window shown in FIG. 1.

As shown in FIG. 2, the sash is comprised of resinous outer surface or shell 22, first and second transparent glass panes 50 and 52, spacer 65, and porous fibrous core 24. The porous fibrous core is preferably glass fiber wool, having a density of from about 6 to about 20 pounds per cubic foot (pcf), although other fibrous materials can be employed. Spacers are well known in the art, and any suitable spacer can be used with the invention. It is to be understood that the panes need not be glass, but can be other transparent material such as polymeric panes. The resinous outer surface or shell is preferably a polymer or other resinous material. Preferably the polymer or resin partially impregnates the wool core, i.e., the resin impregnates the wool only at the exterior thereof. Further, the polymeric shell may also be reinforced with other fibrous materials such as veils, mats, strands or rovings and the like if desired.

The lineals from which the sash can be fabricated can be produced according to the above-identified patents which explain the manufacturing process. The core material for a structural member is originally formed as a glass fiber board including glass wool impregnated with up to about 20 percent preferably about 14 percent, by weight of a phenolic resin binder such as phenol-urea-formaldehyde. The boards are molded and cured to a density of less than about 20 pounds per cubic foot, preferably 7 to 12 pounds per cubic foot, and to an appropriate thickness.

The inner edge 36 of the sash is configured to receive the spaced apart glass panes which define cavity 51 therebetween. Further, inner edge 36 contains at least one, and preferably a plurality of orifices 38 extending through the resinous shell of the inner edge of the sash so as to expose the porous core to the cavity.

Opposite the inner edge 36 is a sash outer edge 32. This also contains at least one and preferably a plurality of orifices 34 extending through the resinous shell of the outer edge of the sash so as to expose the porous core to the exterior of the sash. Preferably, orifices 34 are located to communicate with the ambient air outside the building in which the window is located. Thus, air is free to flow into and out of the cavity and through the sash. The porous core acts as a filter to keep dirt and insects from entering the cavity. As shown in FIG. 2, orifices 34 and orifices 38 extend through the resinous shell of the sash, but do not extend through the fibrous core.

First glass pane 50 is secured to lip 29 of the inner edge of the sash by any suitable means, such as a bead of adhesive 54. As shown, second glass pane 52 is maintained in spaced-relation to first pane 50 by a spacer means, such as spacer 65 which is in contact with the inner edge of the sash. The spacer, as shown, also has a porous, fibrous glass wool core 67 and a solid polymeric or hardened resinous shell or outer surface 69. The shell of the spacer contains a pair of opposed apertures 71 and 73 exposing the porous core of the spacer. When the spacer is properly positioned, spacer aperture 73 is aligned with orifice 38 of the sash to facilitate the movement of air and moisture into and out of the cavity. This reduces the tendency of moisture to condense on the glass pane. The excess moisture in the cavity is vented through the wool core of the sash in the form of water vapor. The core of the spacer acts as a second filter. It is to be understood that the "second filter" is optional. That is, spacer aperture 71 may extend completely through the spacer core to meet spacer aperture 73 to form a continuous passageway therethrough if desired. Or, the spacer may be fabricated from any other suitable material besides the porous core/polymeric shell material system shown.

Second pane 52 is sealed by "U" shaped trim element 53, which may be held in the sash by any suitable means, for example bayonet type fasteners (not shown), as is known in the art. Typically, a gasket 56 is positioned between the spacer and trim element 53 to seal the cavity from the interior of the building.

Further, gasket 58, which contacts inner surface 11 of the frame is attached to the sash outer edge. Preferably this gasket is positioned between sash orifice 34 and sash rear face 30 to eliminate any flow of air through the gap between the sash and the frame. It is important for gasket 58 to be on the interior side of the building relative to orifice 34 to ensure that the air and moisture from the cavity is vented to the exterior of the building. The sash is positively located in the closed position by contact between the sash face and landing 9 of the frame.

Figure 3:
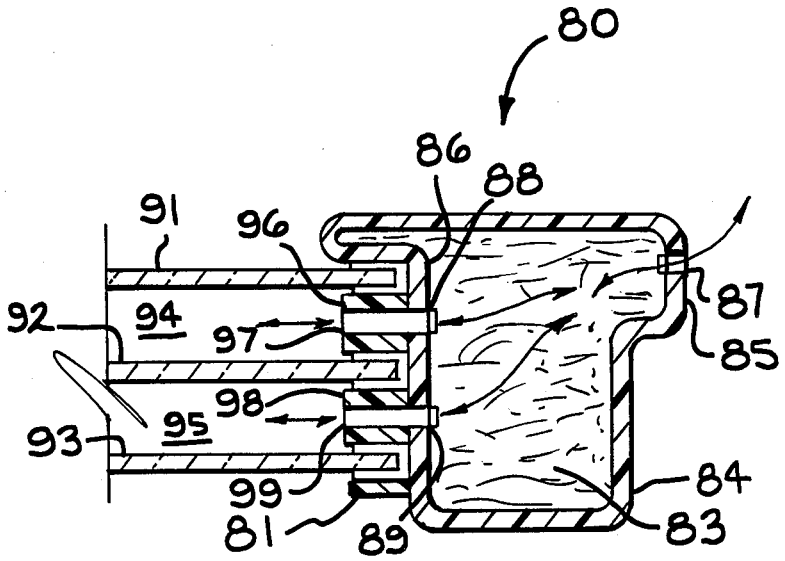
FIG. 3 is an enlarged cross-sectional view of another window having three panes of glass, according to the principles of the present invention.

FIG. 3 sets forth a triple pane window assembly according to the principles of the present invention. As such, sash 80 includes porous, fibrous core 83, preferably glass wool, having a solid shell or outer surface 84. Sash inner edge 86 has at least one and preferably a plurality of orifices 88 in communication with first cavity 94 formed between first pane 91 and second pane 92. First spacer 96 has apertures 97 extending therethrough in communication with sash orifice 88.

Similarly, inner edge 86 has at least one and preferably a plurality of orifices 89 in communication with second cavity 95 formed between second pane 92 and third pane 93. Second spacer 98 has apertures 99 extending therethrough in communication with sash orifices 89. Outer edge 85 of the sash has at least one and preferably a plurality of orifices 87. Sash orifices 87, 88 and 89 all extend through the sash shell to expose the sash porous core; this acts to filter dirt and insects from cavities 94 and 95. Further, first cavity 94 is in communication with second cavity 95 as well as the ambient air at the exterior of the window because of the inherent porosity of the fibrous glass core 83 of the sash.

Panes 92 and 93 as well as spacers 96 and 98 are held in place by fastening means 81 which may be of any suitable type. If desired, spacers 96 and 98 may be of the "filtering" type similar to spacer 65 employed in FIG. 2.

It is apparent that within the scope of the present invention, modifications and different arrangements can be made other than as herein disclosed. The present disclosure is merely illustrative, with the invention comprehending all variations thereof.

INDUSTRIAL APPLICABILITY

The invention disclosed herein is readily applicable to the window and door industry.

We claim:

1. In an assembly for a window or door of the type having at least two spaced apart panes positioned in a sash fabricated from lineals having a fibrous glass wool core and a hardened resinous outer surface, the panes defining a cavity therebetween, the improvement comprising: a plurality of orifices in the resinous outer surface of the sash, where the orifices do not extend through the wool core, and where the wool core is exposed via the orifices to (a) the cavity between the panes and (b) the exterior of the sash to permit movement of air and moisture between the cavity and the exterior of the sash, where the movement of air and moisture is through the wool core, with the wool core acting as a filter.

2. The assembly claim 1 further comprising a spacer means positioned between the panes at the outer periphery thereof in contact with the sash, the spacer means having apertures in communication with the orifices in the sash to permit said air movement.

3. The assembly of claim 2 wherein the apertures in the spacer means are aligned with the sash orifices in communication with the cavity.

4. The assembly of claim 3 wherein said spacer is fabricated from a lineal having a fibrous glass wool core and a hardened resinous outer surface.

5. The assembly of claim 4 wherein the apertures in the spacer extend only through the resinous outer-surface, the wool core therein being adapted to filter the air moving therethrough.

6. The assembly of claim 3 wherein the apertures extend completely through the spacer.

7. The assembly of claim 1 wherein pairs of the orifices in the sash in communication with the cavity are coaxially aligned on opposite sides of the sash lineal with the orifices in communication with the exterior of the sash.

8. The assembly of claim 1 wherein the panes are glass.

9. The assembly of claim 1 wherein the panes are polymeric.

10. In an assembly for a window or door of the type having a sash having a fibrous wool core and an outer shell, the sash being configured to receive at least two spaced apart panes, the panes defining a cavity therebetween, the improvement comprising: a plurality of orifices in the shell of the sash, where the orifices do not extend through the wool core, and where the wool core is exposed via the orifices to (a) the cavity between the panes and (b) the exterior of the sash to permit movement of air and moisture between the cavity and the exterior of the sash, where the movement of air and moisture is through the wool core, with wool core acting as a filter.

11. The assembly of claim 10 wherein the wool core is comprised of fibrous glass.

12. The assembly of claim 11 wherein the wool core has a density less than about 20 pounds per cubic foot.

13. The assembly of claim 12 wherein the outer shell is polyester resin.

14. The assembly of claim 13 wherein the polyester resin outer shell extends partially into the wool core.

15. In an assembly for a window or door of the type having three spaced apart panes defining two cavities therebetween, the panes being positioned in an after-defined sash, and a sash having a porous fibrous core and an outer shell, the improvement comprising: a plurality of orifices in the outer shell of the sash, where the orifices do not extend through the fibrous core, and where the fibrous core is exposed via the orifices to (a) both the cavities between the panes and (b) the exterior of the sash to permit movement of air and moisture between the cavities and the exterior of the sash, where the movement of air and moisture is through the fibrous core, with the fibrous core acting as a filter.

16. The assembly of claim 15 wherein the outer shell is made from a polymeric resin which partially impregnates the fibrous core.

* * * * *